US007258097B1

(12) United States Patent
Snyder et al.

(10) Patent No.: US 7,258,097 B1
(45) Date of Patent: Aug. 21, 2007

(54) CRANKCASE FOR AN INTERNAL COMBUSTION ENGINE

(75) Inventors: W. Bryan Snyder, Westland, MI (US); Robert Z. Olszewski, Glen Ellyn, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 11/463,212

(22) Filed: Aug. 8, 2006

(51) Int. Cl.
*F02F 7/00* (2006.01)

(52) U.S. Cl. ..... 123/196 R; 123/195 R

(58) Field of Classification Search ..... 123/196 R, 123/195 R
See application file for complete search history.

(56) References Cited

U.S. PATENT DOCUMENTS 5,190,005 A * 3/1993 Saito et al. ..... 123/196 R
5,216,984 A * 6/1993 Shimano et al. ..... 123/41.44
6,571,763 B1 * 6/2003 Bakker ..... 123/195 R

* cited by examiner

*Primary Examiner*—Stephen K. Cronin
*Assistant Examiner*—Jason Benton
(74) *Attorney, Agent, or Firm*—Elias P. Soupos; Susan L. Lukasik; Jeffrey P. Calfa

(57) ABSTRACT

A crankcase (100) for an engine includes a first bank (102) of cylinders that has a plurality of cylinder bores (104) formed therein, and a second bank (102) of cylinders that includes an additional plurality of cylinder bores (104). The second bank (102) is at an angle with respect to the first bank (102). A valley structure (106) is located between the first bank (102) and the second bank (102). A gallery (122) is located between the first bank (102), the second bank (102), and the valley structure (106). The gallery (122) has at least one rear opening (118) that fluidly connects the gallery (102) to a rear portion (120) of the crankcase. At least one front opening (210) fluidly connects the gallery (122) to a front portion (116) of the crankcase (100). At least one breather opening (124) fluidly connects the gallery (122) to an outer valley surface (107).

15 Claims, 2 Drawing Sheets

CRANKCASE FOR AN INTERNAL COMBUSTION ENGINE

FIELD OF THE INVENTION

This invention relates to internal combustion engines, including but not limited to crankcase ventilation for an internal combustion engine.

BACKGROUND OF THE INVENTION

Internal combustion engines include crankcases having a plurality of cylinders. The cylinders contain pistons whose reciprocating motion due to combustion events that occur in a variable volume within a plurality of bores in the crankcase that contain the pistons, and the pistons themselves, may be transferred through a crankshaft to yield a torque output of the engine. Often, engine crankcases are made of cast metal, and include passages integrally formed therein for the transfer of various fluids from one location of the engine to another. Fluids typically transferred through passages in an engine include coolant, air, fuel, oil, gases, vapors, and so forth.

During operation of the engine, a mixture of air and fuel combusts in a cylinder, and exhaust gas that is produced by the combustion is released therefrom through one or more exhaust valves. Sometimes, a small quantity of exhaust gas may escape through a seal between the piston and the bore, and enter an internal volume of the crankcase. This small amount of exhaust gas is commonly referred to as "crankcase gas". The crankcase gas is typically allowed to exit the crankcase in a controlled fashion, and is usually recirculated into the intake system of the engine. Crankcase gas often includes some amount of lubrication oil of the engine. This amount of oil is either vaporized and/or splashed by various engine components during operation, or is just picked up when it sublimes due to heat by the crankcase gas in droplet or gas form as the crankcase gas travels through the crankcase. Devices called "breathers" are used to remove oil from the crankcase gas before it's recirculated into the intake of the engine.

A typical breather device may include a filter or another method that removes oil from the crankcase gas. The more oil that is included in the crankcase gas, the larger and more costly the breather must be to effectively remove the oil that is included in the crankcase gas. Use of breathers is often determined by the size of the engine and the cylinder pressures during combustion. For larger engines, or engines having comparatively high cylinder pressures during operation, for example diesel engines, breathers may become large and costly.

Accordingly, there is a need for an ability to decrease the amount of oil carried with the crankcase gas before the gas reaches the breather, in order to decrease the size and increase the effectiveness of a breather for an engine that would otherwise require a larger breather device. The smaller breather would be easier to fit onto the engine, less costly, and more effective than a breather that would typically be required.

SUMMARY OF THE INVENTION

A crankcase for an internal combustion engine includes a first bank of cylinders that has a plurality of cylinder bores formed therein, and a second bank of cylinders that includes an additional plurality of cylinder bores formed therein. The second bank is at an angle with respect to the first bank. A valley structure is located between the first bank and the second bank. A gallery is advantageously located between the first bank, the second bank, and the valley structure. The gallery has at least one rear opening that fluidly connects the gallery to a rear portion of the crankcase. At least one front opening fluidly connects the gallery to a front portion of the crankcase, and at least one breather opening fluidly connects the gallery to an outer valley surface.

DESCRIPTION OF A PREFERRED EMBODIMENT

The following describes an apparatus for and method of transferring crankcase gases or vapors from and through an internal cavity of a crankcase to an opening for a breather that effectively removes oil droplets from the crankcase gas before reaching the breather.

Figure 1:
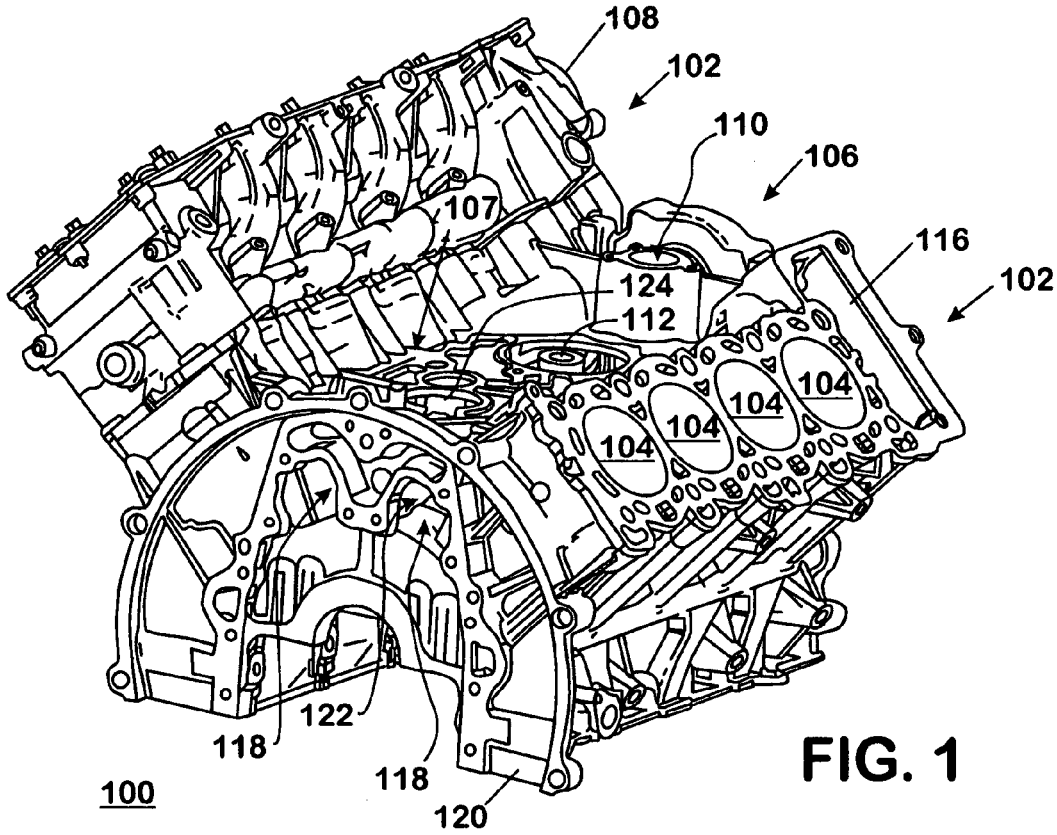
FIG. 1 is an outline view from a rear perspective of a crankcase in accordance with the invention.

An outline of a crankcase 100 for an engine is shown in FIG. 1. The crankcase 100 shown is a crankcase for an eight (8) cylinder engine having a "V" configuration. Two banks 102 each having four (4) cylinders 104 are oppositely located on either side of the crankcase 100 along its entire length. The cylinder banks 102 are connected to a valley structure 106 occupying a central portion of the crankcase 100 and having an outer valley interface surface 107. A cylinder head 108 is shown attached to the crankcase 100 on one of the cylinder banks 102. The cylinder head 108 may include additional engine components (not shown) such as fuel injectors, intake and exhaust valves, over-head camshafts, and so forth. The crankcase 100 may also include a number of different integrated passages and/or cavities. For example, a coolant passage 110, an oil passage 112, a timing chain or belt cavity 116, and others, may be formed in the crankcase 100.

A set of rear openings 118 may be formed during a casting operation in a rear portion 120 of the crankcase 100. The rear openings 118 may be fluid entrances to a gallery 122 that may be formed by a relatively large core (not shown) during the same casting operation that forms the rear openings 118 and the crankcase 100. A breather opening 124 may be fluidly connected to the gallery 122, and thus, also in fluid communication with the rear openings 118. The gallery 122 is advantageously disposed along an entire length of the crankcase 100, between the bores 104 and the valley structure 106.

Figure 2:
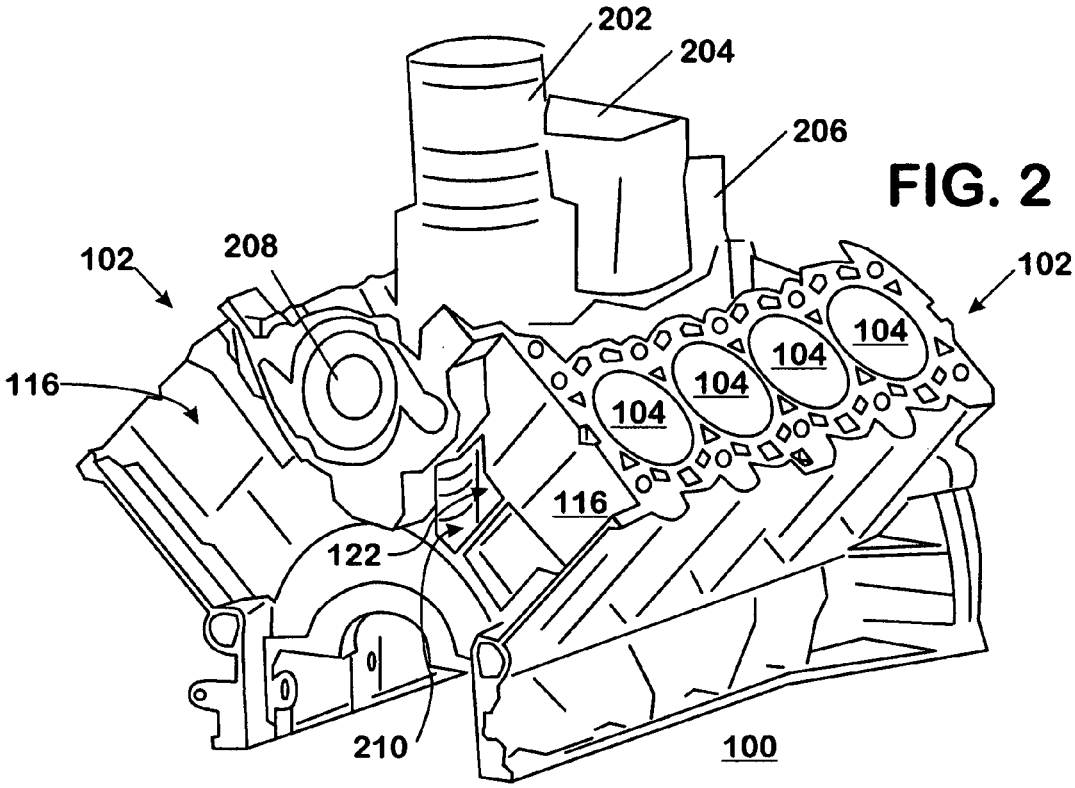
FIG. 2 is an outline view from a front perspective of a crankcase in accordance with the invention.

A front cross-section view of the crankcase 100 is shown in FIG. 2. The crankcase 100 is shown here to include an oil filter 202, an oil-cooler 204, and a breather 206 connected to the valley structure 106 thereof. Fluid connections to these components may be integrated in the valley structure 106 as described, and specifically, the breather 206 may be in fluid communication to the breather opening 124 (shown in FIG. 1). The crankcase 100 may have a water pump housing 208 integrated therewith, and may advantageously have a set of front openings 210 that fluidly communicate with the gallery 122. The front openings 210 may be disposed on either side of the housing 208 (only one is visible) and may be formed during the casting operation used to form the crankcase 100.

The front openings 210 may advantageously fluidly connect the gallery 122 with one or both of the timing chain or belt cavities 116.

Figure 3:
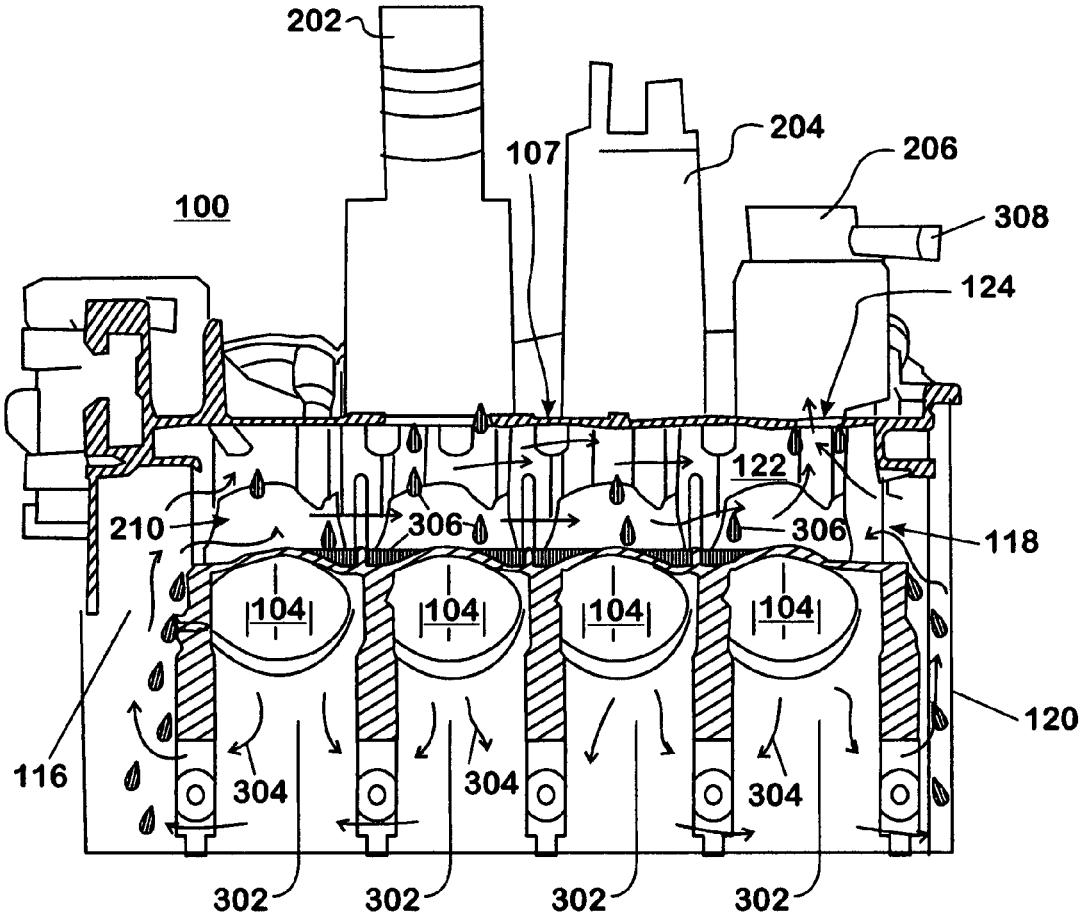
FIG. 3 is a cross-section view of a crankcase having a gallery formed therein in accordance with the invention.

A side cross-section view of the crankcase 100 is shown in FIG. 3. The crankcase 100 may include a plurality of lower chambers 302, each chamber 302 being below each bore 104. When the crankcase 100 is assembled into an engine, each chamber 302 may house a section of a crankshaft (not shown) and a connecting rod (not shown). During operation of the engine that includes the crankcase 100, crankcase gases from the bores 104 may enter the chambers 302. A flow of crankcase gases 304 during operation of the crankcase 100 is denoted by dotted-line open-headed arrows. The flow of gases 304 exiting the bores 104 may be collected and fill the chambers 304. When the chambers 304 have filled with the flow 304, a portion of the flow 304 may exit into the timing chain or belt cavity 116 in the front of the crankcase 100, and a remaining portion of the flow 304 may exit toward the rear portion 120 of the crankcase 100.

The portion of the flow 304 exiting into the timing chain or belt cavity 116 may travel upward and pass through the front opening(s) 210 to enter the gallery 122. Similarly, the remaining portion of the flow 304 at the rear portion 120 may pass through the set of rear openings 188 and enter the gallery 122. The gallery 122 is relatively large with respect to the breather opening 124 to advantageously decelerate the flow of crankcase gases 304 and promote condensation of any oil droplets that may be carried therewith. The decelerated flow 304 may allow an amount of oil that is carried therewith to precipitate into an amount of liquid oil 306, denoted symbolically by vertical-lined thick-crosshatched droplet shapes and pools that may collect in internal crevices of the gallery 122. A portion of the liquid oil 306 that precipitates in the gallery 122 may fill any crevices therein and overflow out of the gallery 122 into a lower region of the engine, for instance into an oil pan (not shown), through the front opening(s) 210, with a remaining portion of the liquid oil 306 exiting the gallery 122 through the set of rear openings 118.

The flow of crankcase gases 304, having precipitated the liquid oil 306, may enter the breather 206 through the breather opening 124, undergo additional filtering, and exit the breather 206 through a breather outlet port 308. Any additional oil that may be precipitated out of the crankcase gases 304 may be collected and returned to the engine through a drain passage (not shown).

When an engine containing the crankcase 100 is fully assembled and operates, a motion of timing chains or belts (not shown) in the cavities 166 may advantageously promote the flow 304 to enter the gallery 122 through the front opening(s) 210 by imparting an upward momentum to the gas as it passes the chains or belts. Moreover, under certain conditions, the liquid oil 306 exiting from the set of rear openings 118 may roll downward and lubricate other engine components, for example gears, that may be disposed at the rear portion 120 of the crankcase 100 when the engine is fully assembled and operates. Additionally, both the rear set of openings 188 and the front opening(s) 210 are sufficiently large to permit support of a casting core (not shown) used to form the gallery 122 during a casting operation for the crankcase 100.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A crankcase for an internal combustion engine, comprising:

a first bank of cylinders that includes a plurality of cylinder bores formed therein;

a second bank of cylinders that includes an additional plurality of cylinder bores formed therein, wherein the second bank is at an angle with respect to the first bank;

a valley structure disposed between the first bank and the second bank;

a gallery disposed between the first bank, the second bank, and the valley structure;

wherein the gallery has at least one rear opening fluidly connecting the gallery to a rear portion of the crankcase, at least one front opening fluidly connecting the gallery to a front portion of the crankcase, and at least one breather opening fluidly connecting the gallery to an outer valley surface.

2. The crankcase of claim 1, further comprising an additional rear opening.

3. The crankcase of claim 1, further comprising a cavity disposed at the front portion of the crankcase, wherein the cavity houses at least one of a timing belt and a timing chain when the crankcase is assembled into an engine, wherein the at least one front opening fluidly connects the gallery to the cavity.

4. The crankcase of claim 1, further comprising an additional rear opening and an additional front opening that are in fluid communication with the gallery.

5. The crankcase of claim 1, further comprising a plurality of lower chambers disposed adjacent to a distal end of the cylinder bores, wherein each of the plurality of the lower chambers is in fluid communication with each other lower chamber, and in fluid communication with the at least one rear opening and with the at least one front opening.

6. An internal combustion engine, comprising:

a crankcase having a right bank, a left bank, a front portion, and a rear portion;

a valley structure that is part of the crankcase and disposed between the right bank and the left bank, wherein the valley structure has a breather opening;

a breather connected to the valley structure that is in fluid communication with the breather opening;

at least one lower chamber formed in the crankcase, wherein the lower chamber is open to the front portion and the rear portion; and a gallery formed in the crankcase, wherein the gallery is disposed between the right bank, the left bank, and the valley structure;

wherein the gallery is in fluid communication with the front portion of the crankcase through at least one front opening that is formed in the crankcase adjacent to a distal end of the gallery, wherein the gallery is in fluid communication with the rear portion of the crankcase through at least one rear opening that is formed in the crankcase adjacent to another distal end of the gallery, wherein a first path for a portion of a flow of gas is defined between the at least one lower chamber, the front portion, the front opening, the gallery, the breather opening, and the breather, and wherein a second path for a remaining portion of the flow of gas is defined between the at least one lower chamber, the rear portion, the rear opening, the gallery, the breather opening, and the breather.

7. The internal combustion engine of claim 6, further comprising an additional rear opening formed in the crankcase that fluidly connects the gallery with the rear portion of the crankcase.

8. The internal combustion engine of claim 6, further comprising an additional front opening formed in the crankcase that fluidly connects the gallery with the front portion of the crankcase.

9. The internal combustion engine of claim 6, further comprising a timing cavity disposed adjacent to the front portion of the crankcase, wherein timing cavity fluidly connects the at least one lower chamber with the at least one front opening.

10. The internal combustion engine of claim 6, wherein the gallery is capable of allowing an amount of liquid oil to drain therefrom through the at least one front opening and the at least one rear opening.

11. A casting for a crankcase for an internal combustion engine, comprising:

a right bank structure having a first plurality cylinder bores formed therein;

a left bank structure having a second plurality of cylinder bores formed therein;

a valley structure disposed between the right bank structure and the left bank structure;

wherein a gallery that is formed in the crankcase by a single core during a casting operation is disposed between the right bank structure, the left bank structure, and the valley structure.

12. The casting of claim 11, further comprising at least one rear opening that fluidly connects to the gallery.

13. The casting of claim 11, further comprising at least one rear opening that fluidly connects to the gallery.

14. The casting of claim 11, further comprising at least one breather opening formed in the valley structure that fluidly connects to the gallery.

15. The casting of claim 11, further comprising at least one lower chamber formed in the casting that is disposed adjacent to the first plurality of cylinder bores and the second plurality of cylinder bores, wherein the at least one lower chamber is in fluid communication with the gallery through the at least one front opening and the at least one rear opening.

* * * * *